US012672670B2

(12) United States Patent
Jeoung et al.

(10) Patent No.: US 12,672,670 B2
(45) Date of Patent: Jul. 7, 2026

(54) SMOKING ARTICLE COMPRISING COMBUSTIBLE HEAT SOURCE IN WHICH AIRFLOW HOLE IS FORMED

(71) Applicant: KT&G CORPORATION, Daejeon (KR)

(72) Inventors: Eunmi Jeoung, Yuseong-gu (KR); Moonwon Kim, Yuseong-gu (KR)

(73) Assignee: KT&G CORPORATION, Daejeon (KR)

( * ) Notice: Subject to any disclaimer, the term of this patent is extended or adjusted under 35 U.S.C. 154(b) by 298 days.

(21) Appl. No.: 18/036,734

(22) PCT Filed: Nov. 28, 2022

(86) PCT No.: PCT/KR2022/018997
§ 371 (c)(1),
(2) Date: May 12, 2023

(87) PCT Pub. No.: WO2023/121026
PCT Pub. Date: Jun. 29, 2023

(65) Prior Publication Data

US 2024/0341350 A1 Oct. 17, 2024

(30) Foreign Application Priority Data

Dec. 20, 2021 (KR) ..... 10-2021-0182680

(51) Int. Cl.
*A24D 1/22* (2020.01)
*A24D 1/02* (2006.01)

(52) U.S. Cl.
CPC ..... *A24D 1/22* (2020.01); *A24D 1/027* (2013.01)

(58) Field of Classification Search
None
See application file for complete search history.

(56) References Cited

U.S. PATENT DOCUMENTS 4,793,365 A * 12/1988 Sensabaugh, Jr ..... A24D 1/22 131/194
4,819,665 A * 4/1989 Roberts ..... A24D 1/22 131/194

(Continued)

FOREIGN PATENT DOCUMENTS

CN 103549657 A 2/2014
EP 3 300 616 A1 4/2018

(Continued)

OTHER PUBLICATIONS

Extended European Search Report dated Apr. 24, 2024, issued in European Application No. 22891173.1.

(Continued)

*Primary Examiner* — Philip Y Louie
*Assistant Examiner* — Jeffrey A. Buckman
(74) *Attorney, Agent, or Firm* — Sughrue Mion, PLLC

(57) ABSTRACT

The present disclosure provides a smoking article comprising a combustible heat source, comprising: a first part containing a combustible heat source; a second part containing a tobacco material; an airflow hole extending to the upstream side of the combustible heat source from the downstream side end of the first part; and a buffer space located between the first part and the second part and connected to the airflow hole, wherein the airflow hole does not penetrate the combustible heat source. The smoking article has an effect of improving combustion persistency by using a combustible heat source to which an airflow hole is applied.

8 Claims, 3 Drawing Sheets

(56) References Cited

U.S. PATENT DOCUMENTS

| | | | | |
|---|---|---|---|---|
| 5,183,062 | A | 2/1993 | Clearman et al. | |
| 2015/0013703 | A1* | 1/2015 | Akiyama | A24D 1/002 131/329 |
| 2016/0135495 | A1* | 5/2016 | Poget | A24D 1/027 131/336 |
| 2017/0000188 | A1 | 1/2017 | Nordskog et al. | |
| 2017/0325499 | A1 | 11/2017 | Farah | |

FOREIGN PATENT DOCUMENTS

| | | | |
|---|---|---|---|
| JP | 3325591 | B2 | 9/2002 |
| JP | 2016-527893 | A | 9/2016 |
| JP | 2019-503669 | A | 2/2019 |
| JP | 6580043 | B2 | 9/2019 |
| KR | 10-2004-0045920 | A | 6/2004 |
| KR | 10-2020-0128745 | A | 11/2020 |
| KR | 10-2021-0104402 | A | 8/2021 |
| KR | 10-2021-0104403 | A | 8/2021 |
| WO | 2009/022232 | A2 | 2/2009 |
| WO | 2015/028654 | A1 | 3/2015 |
| WO | 2021/122451 | A1 | 6/2021 |

OTHER PUBLICATIONS

Office Action issued Jul. 2, 2024 in Japanese Application No. 2023-528506.

International Search Report of PCT/KR2022/018997 dated Mar. 2, 2023 [PCT/ISA/210].

Chinese Office Action dated Jul. 30, 2025, issued in Chinese application No. 202280007437.0.

* cited by examiner

SMOKING ARTICLE COMPRISING COMBUSTIBLE HEAT SOURCE IN WHICH AIRFLOW HOLE IS FORMED

CROSS REFERENCE TO RELATED APPLICATIONS

This application is a National Stage of International Application No. PCT/KR2022/018997, filed Nov. 28, 2022, claiming priority to Korean Patent Application No. 10-2021-0182680, filed Dec. 20, 2021.

TECHNICAL FIELD

The following description relates to a smoking article comprising a combustible heat source in which an airflow hole is formed.

BACKGROUND ART

A number of smoking articles which are heated rather than combusted have recently been proposed. Unlike conventional cigarettes, these non-combustion type smoking articles are used by sucking an aerosol generated by heating the smoking article medium without burning the smoking article medium. As one of these types of heating-type smoking articles, there is a smoking article to which a combustible carbon heat source is applied.

A smoking article to which the combustible carbon heat source is applied generates an aerosol by heat transfer from the combustible carbon heat source to a smoking article medium located downstream of the combustible carbon heat source.

A smoking article product to which the combustible carbon heat source is applied has a smoking form similar to that of a traditional cigarette product, unlike general heating-type electronic smoking articles using a dedicated device, so that its demand is increasing.

RELATED ART DOCUMENT

Patent Document (Patent Document 1) WO2009/022232 (Feb. 19, 2009)

DISCLOSURE OF THE INVENTION

Technical Goals

An object of the present disclosure is to provide a smoking article comprising a combustible heat source, which has improved combustion persistency by forming an airflow hole in the combustible heat source.

Technical Solutions

The present disclosure provides a smoking article 100 comprising a combustible heat source, comprising:

a first part 110 containing a combustible heat source:

a second part 120 containing a tobacco material;

an airflow hole 210 extending to the upstream side of the combustible heat source from the downstream side end of the first part; and a buffer space 220 located between the first part 110 and the second part 120 and connected to the airflow hole 210, wherein the airflow hole does not penetrate the combustible heat source.

In one embodiment of the present disclosure, the diameter $d_2$ of the airflow hole may have a length of 5 to 60% of the diameter $d_1$ of the combustible heat source, and the depth $l_2$ of the airflow hole may have a length of 10 to 80% of the length $l_1$ of the combustible heat source.

In another embodiment of the present disclosure, the combustible heat source may have a diameter $d_1$ of 6 to 12 mm, and the airflow hole may have a diameter $d_2$ of 1 to 5 mm.

In yet another embodiment of the present disclosure, the combustible heat source may have a length $l_1$ of 10 to 16 mm, and the airflow hole may have a depth $l_2$ of 1 to 12 mm.

In still another embodiment of the present disclosure, the buffer space 220 may have a length of 0.5 to 3 mm.

In yet still another embodiment of the present disclosure, the second part 120 in contact with the buffer space 220 may have a metal barrier 300 formed in the end thereof.

In a further embodiment of the present disclosure, the smoking article may comprise a thermally conductive wrapper 160 surrounding the first part 110 and the second part 120.

In a yet further embodiment of the present disclosure, the thermally conductive wrapper 160 may include one or more perforations 161 in the outer circumferential surface thereof.

In a still further embodiment of the present disclosure, the smoking article may comprise an outer cigarette paper 150 surrounding the smoking article comprising a combustible heat source.

In a yet still further embodiment of the present disclosure, the thermally conductive wrapper 160 and the outer cigarette paper 150 may include one or more perforations 161 and 151 in the outer circumferential surface thereof.

In another embodiment of the present disclosure, the perforations may have a size of 0.5 mm or less.

In yet another embodiment of the present disclosure, the smoking article 100 comprising a combustible heat source may further comprise a third part 130 containing a cooling material, and a fourth part 140 containing a filter material.

Effects

The smoking article comprising a combustible heat source according to the present disclosure is characterized by having excellent combustion persistency by using a combustible heat source having an airflow hole.

BEST MODE FOR CARRYING OUT THE INVENTION

Figure 1:
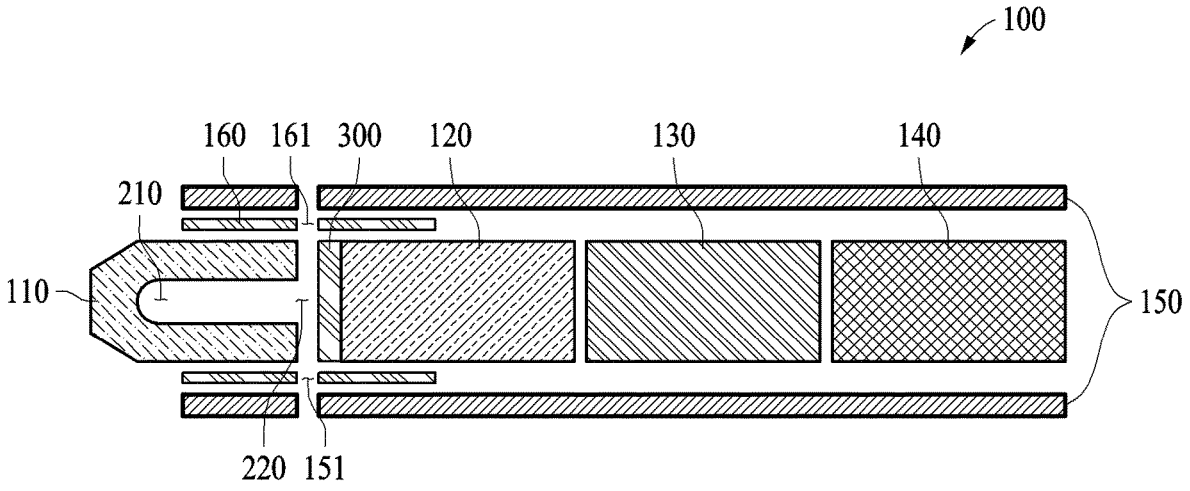
FIG. 1 is a view showing a configuration of a smoking article comprising a combustible heat source according to the present disclosure.

Hereinafter, the present disclosure will be described in detail so that those skilled in the art to which the present disclosure pertains can easily carry out the present disclosure. However, the present disclosure may be embodied in many different forms and is not limited to the content described herein.

Further, in the description with reference to the accompanying drawings, the same components are assigned the same reference numerals regardless of the reference numerals, and overlapping descriptions thereof will be omitted. In the description of the embodiments, if it is determined that a detailed description of a related known technology may unnecessarily obscure the gist of the embodiments, the detailed description thereof will be omitted.

Throughout the specification, "lengthwise direction of a smoking article comprising a combustible heat source" means a direction in which the length of the smoking article comprising a combustible heat source extends or a direction in which combustion proceeds when the smoking article comprising a combustible heat source is combusted.

Throughout the specification, in the terms "upstream" and "downstream", a part where air enters from the outside to the inside of the smoking article comprising a combustible heat source when the user sucks in outside air using a smoking article comprising a combustible heat source is an "upstream", and a portion where air exits from the inside to the outside of the smoking article comprising a combustible heat source is a "downstream". The terms "upstream" and "downstream" may be used to indicate the relative position or direction between parts or segments that make up the smoking article comprising the combustible heat source. For example, the upstream side end of the heat source may refer to the end surface of the thermal source side of the smoking article, and the downstream side end of the heat source may refer to the face that is in contact with the buffer space.

Hereinafter, the embodiments of the present disclosure will be described in detail with reference to the drawings.

FIG. 1 is a view showing a configuration of a smoking article comprising a combustible heat source.

Referring to FIG. 1, the smoking article 100 comprising a combustible heat source comprises, for example, a first part 110 containing a combustible heat source, a second part 120 containing a tobacco material, and the first part 110 and the second part 120 are aligned in order based on the longitudinal direction of the smoking article 100 comprising a combustible heat source.

The smoking article 100 is characterized by having an airflow hole 210. The airflow hole 210 is formed concave inside the combustible heat source and extends from the downstream side end of the first part of the combustible heat source to the upstream side of the combustible heat source. When smoking the smoking article, the combustion is proceeded by lighting a fire the front end portion of the combustible heat source, which is the uppermost stream of the smoking article. The airflow hole is characterized by having a structure in which the entire heat source is "not penetrated". The airflow hole does not penetrate the entire heat source so that a smoking time of 180 seconds or more may be obtained while the combustion temperature of the heat source is proceeded at a smokable temperature.

Here, the first part 110 and the second part 120 are disposed while maintaining a predetermined distance from each other, and the buffer space 220 connected to the airflow hole is included therebetween. The airflow hole 210 and the buffer space 220 are formed by sharing an empty space that is substantially connected. A metal barrier 300 is formed at the end of the second part 120 in contact with the buffer space 220, that is, the upstream side end of the second part.

The combustible heat source may be, for example, a carbonaceous heat source. In addition, the combustible heat source may have a porous structure. As used in the present application, the term 'carbonaceous' is used to describe a combustible heat source containing carbon. Preferably, a combustible carbonaceous heat source for use in a smoking article according to the present disclosure may contain at least about 40 dry weight %, at least about 50 dry weight %, at least about 60 dry weight %, at least about 70 dry weight %, or at least about 80 dry weight % of carbon based on the combustible heat source.

If desired, one or more binders may be combined with one or more carbon-containing materials. Preferably, one or more binders are an organic binder. Known suitable organic binders are not limited thereto, but include gum (e.g., guar gum), modified cellulose derivatives and cellulose (e.g., methylcellulose, carboxymethylcellulose, hydroxypropyl cellulose, and hydroxypropyl methylcellulose), flour, starch, sugar, vegetable oil, and combinations thereof.

Instead of the binder, or in addition, the combustible heat source for use in a smoking article according to the present disclosure may include one or more additives to improve the characteristics of this combustible heat source. Suitable additives may include additives (e.g., sintering aids) that promote consolidation of combustible heat sources, additives that promote ignition of combustible heat sources (e.g., oxidizers such as perchlorate, chlorate, nitrate, peroxide, permanganate, zirconium, and combinations thereof), additives for promoting combustion of the combustible heat sources (e.g., potassium and potassium salts such as potassium citrate), and additives that promote decomposition of one or more gases generated by combustion of the combustible heat sources (e.g., catalysts such as CuO, $Fe_2O_3$, and $Al_2O_3$), but are not limited thereto.

The combustible heat source is preferably formed by mixing one or more carbon-containing materials with one or more binders and any other additives (when included), and forming this mixture in advance in the desired shape. The mixture of one or more carbon-containing materials, one or more binders, and other selective additives may be formed in advance in the desired shape by using, for example, any suitable publicly-known ceramic formation methods such as slip casting, extrusion, injection molding and mold compression, or pressurization.

Preferably, the combustible heat source is formed by the pressurization process or extrusion process. Most preferably, the combustible heat source is formed by the pressurization process.

Preferably, the combustible heat source may have an apparent density between about 0.8 $g/cm^3$ and about 3.0 $g/cm^3$, and preferably, the combustible heat source may have a mass between about 300 mg and about 500 mg, more preferably between about 400 mg and about 450 mg.

However, the heat source according to the present disclosure is not necessarily limited to those described above, and the present disclosure may include all heat sources of the publicly-known materials that can provide heat to the smoking article 100 comprising a combustible heat source.

The second part 120 may include a tobacco material. The tobacco material may include, for example, at least one of cut tobacco, cut reconstituted tobacco leaves, smoking article leaves, an expanded smoking article, and a nicotine extract. The tobacco material may contain a nicotine component. In addition to the tobacco material, an aerosol-generating material may be further contained. The aerosol-generating material may include polyhydric alcohols, esters of polyhydric alcohols such as glycerol mono-, di-or triacetate, and aliphatic esters of mono-, di-or esters of polycarboxylic acids such as dimethyl dodecanedioate and dimethyl tetradecanedioate. More specifically, the aerosol-generating material may include, for example, at least one of glycerin, propylene glycol, ethylene glycol, dipropylene glycol, diethylene glycol, triethylene glycol, tetraethylene glycol, and oleyl alcohol. For example, the second part 120 may include cut reconstituted tobacco leaves immersed in glycerin. However, this is an example and the present disclosure is not necessarily limited to the description described above.

The second part may have a length between about 5 mm and about 20 mm, more preferably between about 8 mm and about 12 mm. The second part is surrounded by paper or other wrappers, and may be a plug or a part form comprising a material that can release volatile compounds in response to heating. As described above, if the second part is a plug or part form, the plug or entire part containing any wrapper is considered to be the second part.

In the present disclosure, the smoking article 100 comprising a combustible heat source may further comprise a third part 130 containing a cooling material and a fourth part 140 containing a filter material.

The third part 130 may contain a cooling material. The third part 130 comprises a tubular hollow body with an open end, and may cool the airflow passing through the first part 110 to the second part 120. The third part 130 may be manufactured of a polymer material or a biodegradable polymer material and may have a cooling function. For example, the third part 130 may be paper, cardboard, plastics, for example, cellulose acetate, ceramics, and combinations thereof. In addition, the cooling element may include a corrugated sheet of a material selected from the group consisting of a metal foil, a polymer material, and a substantially non-porous paper or cardboard. In predetermined embodiments, aerosol-cooling elements may also include a corrugated sheet of a material selected from the group consisting of polyethylene (PE), polypropylene (PP), polyvinyl chloride (PVC), polyethylene terephthalate (PET), polylactic acid (PLA), cellulose acetate (CA), and aluminum foil.

The fourth part 140 may comprise a filter material. The fourth part 140 may be, for example, a cellulose acetate filter. Meanwhile, there is no limit to the shape of the fourth part 140. For example, the fourth part 140 may be a cylinder-type rod or a tube-type rod including a hollow therein. In addition, the fourth part 140 may be a recess-type rod. When the fourth part 140 consists of a plurality of segments, at least one of the plurality of segments may be manufactured in a different shape.

In addition to this, the filter part may further comprise a tipping paper in contact with the mouth, which surrounds the fourth part. The tipping paper may have one or more perforations formed therein.

The fourth part 140 may be manufactured to generate flavor. As an example, a flavoring liquid may be sprayed onto the fourth part 140, and a separate fiber coated with the flavoring liquid may be inserted into the fourth part 140.

The third part and the fourth part may contain an aerosol modifier. For example, one or more of the third part, fourth part, and tipping paper of the smoking article according to the present disclosure may contain one or more aerosol modifiers. Suitable aerosol modifiers may not be limited thereto, but may include a flavoring agent and a chemesthetic agent. The flavoring agent is used to describe any substance that, when used, imparts taste, aroma, or both thereof to aerosols generated by a tobacco material and an aerosol-generating material of the smoking article.

The smoking article according to the present disclosure may also comprise downstream one or more aerosol modifiers that are both a flavoring agent and a chemesthetic agent. For example, one or more of the third and fourth parts of the smoking article according to the present disclosure may contain menthol or another flavoring agent that provides a cooling object sensory effect.

In addition, the smoking article 100 comprising a combustible heat source may comprise a thermally conductive wrapper 160 surrounding the first part 110 and the second part 120. The thermally conductive wrapper may completely surround the first part and the second part, surround a portion of the first part and a portion of the second part, or surround a portion of the first part and the entirety of the second part.

The thermally conductive wrapper transfers heat generated from a combustible heat source to the tobacco material, and the wrapper may include metal foil wrappers such as an aluminum foil wrapper, a steel wrapper, an iron foil wrapper, and a copper foil wrapper: and metal alloy foil wrappers, and is not limited to the material as long as it is a material capable of efficiently transferring heat.

A metal barrier 300 is formed at an end of the second part (upstream side end of the second part) in contact with the buffer space. Here, the metal barrier may prevent direct contact of a combustible heat source part with the medium part, and may prevent some out of components generated in the combustible heat source part from moving to the medium part.

The thickness of the barrier may be appropriately adjusted to obtain good smoking performance. In a specific embodiment, the barrier may have a thickness between about 10 microns and about 500 microns. The barrier may include one or more metallic materials that are substantially thermally stable and non-combustible at the temperatures obtained by the combustible heat source upon ignition and combustion. Suitable materials are known in the art and are not limited thereto, but they include aluminum, copper, stainless steel, and combinations thereof.

In addition, the smoking article 100 comprising a combustible heat source may further comprise an outer cigarette paper 150 surrounding a portion or the entirety of the smoking article 100 comprising a combustible heat source. As an example, the outer cigarette paper 150 may surround all of the first part 110, the second part 120, the third part 130, and the fourth part 140, and may surround the first part 110, the second part 120, and the third part 130 except for the filter part.

One or more perforations 161 and 151 may be formed in the thermally conductive wrapper 160 and the outer cigarette paper 150. The perforations 161 and 151 are completely overlapped with each other and thus are substantially connected to each other to function as the same perforation. Through the perforations formed in the thermally conductive wrapper and the outer cigarette paper, heat generated from a heat source may be discharged to the outside of the smoking article, or air outside the smoking article may be flown in. The size of the perforations is preferably 0.5 mm or less so that internal air may be flown out at the same time while external air is being efficiently flown in.

The perforation may be performed by wrapping the first part and the second part with the thermally conductive wrapper and the outer cigarette paper, and then perforating them (on-line), or may be performed by independently perforating (off-line) the thermally conductive wrapper and the outer cigarette paper, and then allowing the perforations to be overlapped and connected to each other in the process of assembling the material. The perforation may be performed by mechanical perforation, electrical perforation, laser perforation, or the like.

When the outer cigarette paper 150 surrounds respective components of the smoking article 100 that comprises a combustible heat source, the bonding force between the respective components may be increased. For example, due to the outer cigarette paper 150, the first part 110, the second part 120, the third part 130, and the fourth part 140 may have a bonding force to each other and may be disposed adjacent to each other. The outer cigarette paper 150 may be formed of, for example, a cellulose wrapping paper. However, the present disclosure is not necessarily limited thereto.

As an example, when the smoking article 100 comprising a combustible heat source is used by a user, the first part 110 is ignited and the user may inhale the fourth part 140 through the mouth. Accordingly, external air of the smoking article 100 comprising a combustible heat source may be flown into the first part 110. That is, external air may form an airflow within the smoking article 100 comprising a combustible heat source.

Figure 2A:
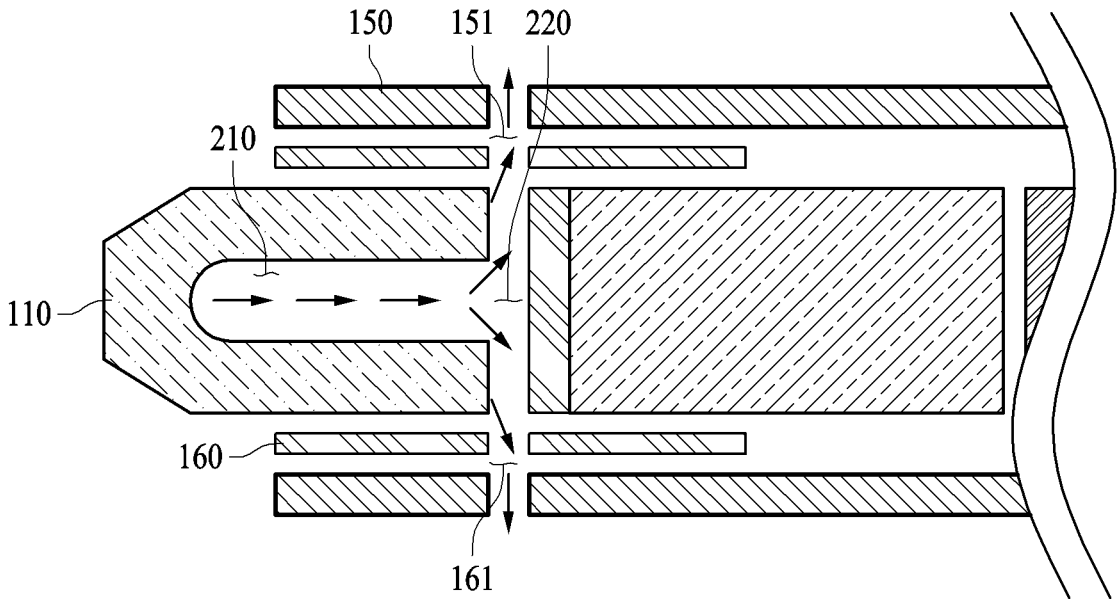
FIG. 2A is a schematic view showing a transmission path of the heated airflow when smoking a smoking article according to the present disclosure.

Referring to FIG. 2A, when the smoking article 100 comprising a combustible heat source is ignited, the heated airflow formed in the first part 110 may be transferred to the buffer space 220 through the airflow hole 210, and may be transferred to the second part 120 through the thermally conductive wrapper and the metal barrier 300. The buffer space 220 may have a thickness of 0.5 to 3 mm, preferably a length of 0.8 to 1.5 mm, so that the combustible heat source and the metal barrier may have a constant distance.

Figure 2B:
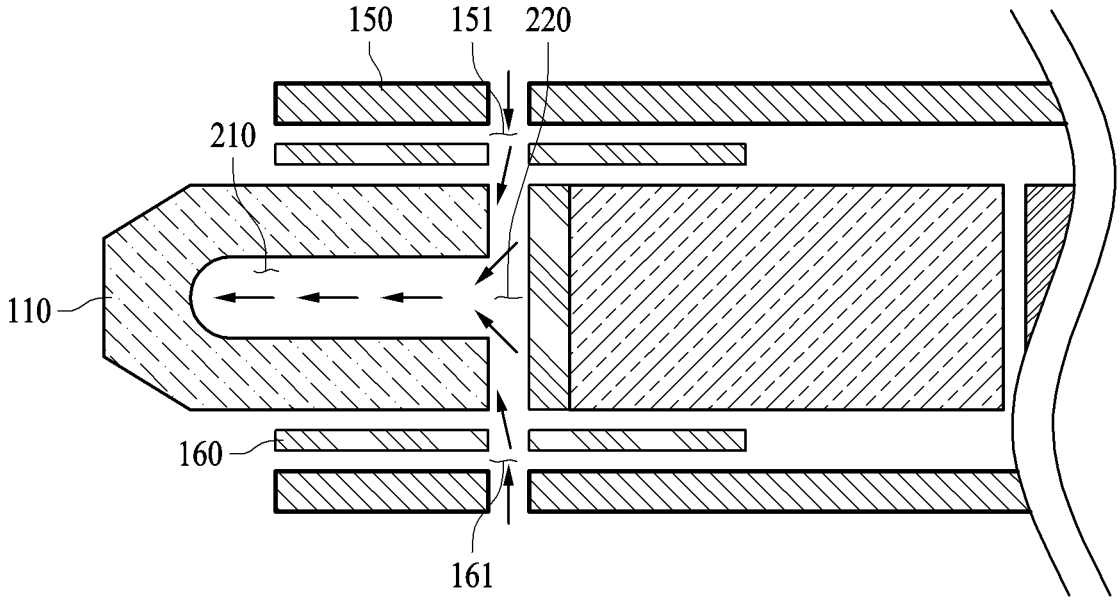
FIG. 2B is a view showing a path where external air flows in when smoking the smoking article according to the present disclosure.

As an example, as shown in FIG. 2A, the heated airflow formed in the first part 110 may be discharged to the outside through the perforation 161 of the thermally conductive wrapper and the perforation 151 of the outer cigarette paper according to the flow indicated by the arrows. As shown in FIG. 2B, external air may be flown into the inside through the perforation 161 of the thermally conductive wrapper and the perforation 151 of the outer cigarette paper according to the flow indicated by the arrows. In general, a combustible heat source and a metal barrier should be as close as possible to increase heat transfer efficiency. However, since complete close contact is difficult in the manufacturing process, the smoking article has the configuration as described above. According to the present disclosure, external air may be continuously flown into the airflow hole of the combustible heat source and the space between the combustible heat source and the barrier by having the above configuration. External air flown in can be moved through the above process, and because of this, continuous air may be provided to the combustible heat source, thereby improving combustion persistency.

Figure 3:
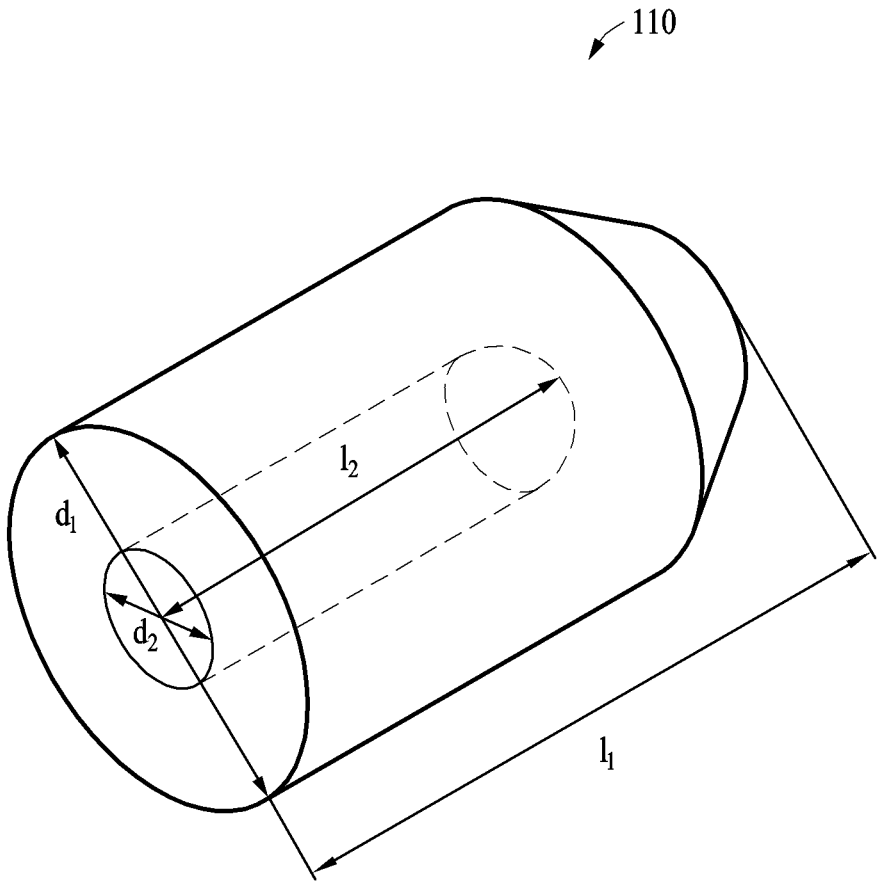
FIG. 3 is an enlarged view of a combustible heat source according to the present disclosure.

FIG. 3 is a view specifically showing the structure of the combustible heat source of the first part 110. The combustible heat source may have a cylindrical shape as a whole, and may have a trapezoidal cross-sectional shape since the diameter of the heat source decreases as it goes toward the front surface so that ends become narrower. However, the structure is not necessarily limited thereto, and the structure may be a structure with a rectangular cross-sectional shape since the heat source has a constant diameter, or it may be a structure with a triangular cross-sectional shape since the diameter converges to 0.

Referring to FIG. 3, the diameter $d_2$ of the airflow hole may have a length of 5to 60% of the diameter $d_1$ of the combustible heat source, and preferably may have a length of 20 to 40% thereof.

As described above, the airflow hole has a structure that "does not penetrate" the entire heat source, and extends in the longitudinal direction, but does not extend to the front surface of the heat source. The depth $l_2$ of the airflow hole may have a length of to 80% of the combustible heat source length $l_1$, preferably a length of 50 to 70% thereof.

As an example, the combustible heat source may have a diameter $d_1$ of 6 to 12 mm, and the airflow hole may have a diameter $d_2$ of 1 to 5 mm.

DESCRIPTION OF REFERENCE NUMERALS

100: Smoking article comprising combustible heat source
110: First part
120: Second part
130: Third part
140: Fourth part
150: Outer cigarette paper
151: Perforation
160: Thermally conductive wrapper
161: Perforation
210: Airflow hole
220: Buffer space
300: Metal barrier
$d_1$: Diameter of heat source
$d_2$: Diameter of airflow hole
$l_1$: Length of heat source
$l_2$: Length of airflow hole Hereinafter, Embodiments will be described in detail with reference to the accompanying drawings. However, since various changes can be made to the Embodiments, the scope of rights of the patent application is not restricted or limited by these Embodiments. It should be understood that all changes, equivalents or substitutes to the Embodiments are included within the scope of rights.

Unless defined otherwise, all terms used herein, including technical or scientific terms, have the same meaning as commonly understood by a person of ordinary skill in the art to which the Embodiments belong. Terms such as those defined in commonly used dictionaries should be interpreted as having a meaning consistent with the meaning in the context of the related art, and unless explicitly defined in the present application, they should not be interpreted in an ideal or excessively formal meaning.

EMBODIMENT

1. Heat source manufacturing method

Embodiment 1

A heat source was manufactured according to the following conditions, and a buffer space was formed to a thickness of 1 mm using the same, and then a smoking article was manufactured by assembling a tobacco material, a cooling material, and a filter material. A metal barrier was made to be included between the buffer space and the tobacco material.

Length of a heat source: 12 mm, diameter of the heat source: 8 mm, diameter of an airflow hole: 2 mm, depth of the airflow hole: 7.2 mm, shape of the end of the airflow hole: a round shape After assembling the smoking article, four perforations having a size of 0.5 mm were formed through laser perforation in a portion where the buffer space between the thermally conductive wrapper enclosing the heat source and the tobacco material, and the outer cigarette paper, was formed.

Embodiment 2

A heat source was manufactured in the same manner as in Embodiment 1 except that the shape of the end of the airflow hole was changed to a sharp shape.

Embodiment 3

A heat source was manufactured in the same manner as in Embodiment 1 except that the length of the heat source was changed to 10 mm, and the depth of the airflow hole was changed to 5 mm.

Embodiment 4

A heat source was manufactured in the same manner as in Embodiment 1 except that the length of the heat source was changed to 10 mm, and the depth of the airflow hole was changed to 7 mm.

Embodiment 5

A heat source was manufactured in the same manner as in Embodiment 1 except that the buffer space was changed to a thickness of 2 mm.

Embodiment 6

A heat source was manufactured in the same manner as in Embodiment 1 except that the buffer space was changed to a thickness of 2 mm, the heat source was changed to a length of 14 mm, the airflow hole was changed to a diameter of 2.5 mm, and the airflow hole was changed to a depth of 11.2 mm.

Embodiment 7

A heat source was manufactured in the same manner as in Embodiment 1 except that perforations were changed to a size of 0.7 mm.

Comparative Embodiment 1

A heat source was manufactured in the same manner as in Embodiment 1 except that the smoking article was manufactured without forming an airflow hole in the heat source.

Comparative Embodiment 2

A heat source was manufactured in the same manner as in Embodiment 1 except that the smoking article was manufactured without forming a buffer space.

Comparative Embodiment 3

A heat source was manufactured in the same manner as in Embodiment 1 except that the airflow hole was changed to a depth of 11 mm.

Comparative Embodiment 4

A heat source was manufactured in the same manner as in Embodiment 1 except that the smoking article was manufactured without forming the perforations.

2. Checking combustion persistency

The combustion duration times were checked by smoking the smoking articles of Embodiments 1 to 7 and Comparative Embodiments 1 to 4 into an automatic smoking machine under ISO smoking conditions (in a state where the perforation parts of the tip paper were not blocked, a smoking volume of 35 ml at a smoking time of 2 seconds with a smoking cycle of 1 minute was smoked up to 3 mm on the upper side of the tip paper).

The results are shown in Table 1 below.

TABLE 1

| | Combustion duration time |
|---|---|
| Embodiment 1 | 212 |
| Embodiment 2 | 206 |
| Embodiment 3 | 193 |
| Embodiment 4 | 202 |
| Embodiment 5 | 209 |
| Embodiment 6 | 190 |
| Embodiment 7 | 201 |
| Comparative Embodiment 1 | 140 |
| Comparative Embodiment 2 | 159 |
| Comparative Embodiment 3 | 179 |
| Comparative Embodiment 4 | 158 |

Through the above results, the smoking article having the configuration of the present disclosure was confirmed to have good combustion persistency of 180 seconds or more, and the smoking article using a heat source in which no airflow hole was formed was confirmed to have combustion persistency of less than about 160 seconds.

Although the above-mentioned embodiments have been described by limited drawings, those skilled in the art may apply various technical modifications and alterations based on the above-mentioned description. For example, appropriate results can be achieved although described techniques are carried out in a different order from a described method, and/or described elements of a system, structure, apparatus, circuit, etc. are combined or mixed in a different form from the described method, or replaced or substituted with other elements or equivalents.

Therefore, other embodiments, other examples, and equivalents to patent claims belong to the scope of the patent claims to be described later.

The invention claimed is:

1. A smoking article comprising a combustible heat source, comprising:

a first part containing a combustible heat source;

a second part containing a tobacco material;

a thermally conductive wrapper surrounding the first part and the second part;

an airflow hole extending toward the upstream side of the combustible heat source from the downstream side end of the first part;

a buffer space located between the first part and the second part and connected to the airflow hole, and an outer cigarette paper surrounding the smoking article comprising the combustible heat source, wherein the airflow hole does not penetrate the combustible heat source, wherein the combustible heat source is not penetrated, wherein the depth of the airflow hole has a length of 50 to 70% of the length of the combustible heat source, and wherein the thermally conductive wrapper and an outer circumferential surface of the outer cigarette paper include one or more perforations thereof.

2. The smoking article of claim 1, wherein the diameter of the airflow hole has a length of 5 to 60% of the diameter of the combustible heat source.

3. The smoking article of claim 2, wherein the combustible heat source has a diameter of 6 to 12 mm, and the airflow hole has a diameter of 1 to 5 mm.

4. The smoking article of claim 2, wherein the combustible heat source has a length of 10 to 16 mm, and the airflow hole has a depth of 1 to 12 mm.

5. The smoking article of claim 1, wherein the buffer space has a length of 0.5 to 3 mm.

6. The smoking article of claim 1, wherein the second part in contact with the buffer space has a metal barrier formed in the end thereof.

7. The smoking article of claim 1, wherein the perforations have a size of 0.5 mm or less.

8. The smoking article of claim 1, wherein the smoking article comprising a combustible heat source further comprises a third part containing a cooling material, and a fourth part containing a filter material.

* * * * *